US005758933A

United States Patent [19]

Clendening

[11] Patent Number: 5,758,933

[45] Date of Patent: Jun. 2, 1998

[54] COMBINATION MAINTENANCE CENTER, FIREARM SUPPORT AND UTILITY STORAGE BOX

[76] Inventor: James Randall Clendening, 1333 Roberts Rd., Goodlettsville, Tenn. 37072

[21] Appl. No.: 626,720

[22] Filed: Apr. 1, 1996

[51] Int. Cl.[6] ..... A47B 45/00; B65D 85/00

[52] U.S. Cl. ..... 312/205; 312/309; 312/282; 312/351.3; 206/315.11; 206/317; 211/64

[58] Field of Search ..... 312/309, 205, 312/244, 280, 282, 313, 351.1, 351.3, 285; 206/315.1, 315.11, 579, 317; 211/64

[56] References Cited

U.S. PATENT DOCUMENTS

| | | | |
|---|---|---|---|
| 394,847 | 12/1888 | French | 312/282 X |
| 2,266,850 | 12/1941 | Connor et al. | 312/205 X |
| 2,290,545 | 7/1942 | Doering | 211/64 |
| 2,429,362 | 10/1947 | McDowell | 312/205 X |
| 2,628,145 | 2/1953 | Slattery | 312/205 |
| 2,666,679 | 1/1954 | Olofsson | 312/282 X |
| 2,774,563 | 12/1956 | Pribis | 206/317 X |
| 2,987,846 | 6/1961 | Powell | 312/285 X |
| 4,232,919 | 11/1980 | Stewart | 211/64 X |
| 4,828,340 | 5/1989 | Jorgensen | 312/311 X |
| 4,940,299 | 7/1990 | Lazenby | 312/285 |
| 5,058,302 | 10/1991 | Minneman | 206/315.11 X |

FOREIGN PATENT DOCUMENTS

| | | | |
|---|---|---|---|
| 2231335 | 12/1974 | France | 312/244 |
| 631640 | 11/1949 | United Kingdom | 312/309 |

*Primary Examiner*—Peter M. Cuomo
*Assistant Examiner*—Hanh V. Tran
*Attorney, Agent, or Firm*—Waddey & Patterson; Laura K Thomas

[57] ABSTRACT

A utility box for use in shooting sports comprising a top, a base, a front, a back and spaced apart ends defining a substantially hollow interior. The container further comprises a plurality of drawers for receiving a variety of tools, accessories and supplies. A portion of the interior includes a plurality of shelves, which are accessible through a hinged door attached at a side of the container. The container further includes a pair of support arms pivotally attached at the ends of the container. The support arms include notches configured to receive a firearm. The container further includes a pair of legs extendable from a housing in the base of the container. The legs and the interior of the housing include cooperating wedging surfaces for locking the legs into a variety of user selected positions. The legs and the interior of the housing further include a tab and a plurality of teeth, respectively, which cooperatively engage to lock the legs into any of a plurality of user selected positions.

18 Claims, 7 Drawing Sheets

COMBINATION MAINTENANCE CENTER, FIREARM SUPPORT AND UTILITY STORAGE BOX

BACKGROUND OF INVENTION

1. Field of the Invention

The present invention relates generally to utility storage boxes, but more particularly to utility storage boxes for storing shooting accessories which may also serve as a maintenance center and firearm rest for use in shooting sports.

2. Description of the Related Art

The art to which the present invention relates includes utility storage boxes, particularly such boxes configured for use by sportsmen or sportswomen engaged in shooting sports.

Those who participate in the shooting sports will attest to the necessity of having ready access to a variety of tools, accessories, and other supplies on location at the firing range in order to make adjustments or repairs to their firearms. In addition, the various shooting sports require shooters to equip themselves with certain items that are essential to their participation, such as ammunition, targets, hearing protection, etc.

One problem often encountered by shooters is that of conveniently organizing, storing and transporting such items to the shooting range. Shooters must often improve and use available containers, such as tackle boxes, milk crates or other containers which are not specifically designed to accommodate the tools and accessories commonly used in the shooting sports. One drawback associated with many of the commercially available shooter's boxes is that they do not provide an adequate work surface or firearm rest on which the firearm may be supported while being adjusted or repaired. Other boxes include a firearm rest, but do not provide adequate storage space for tools, accessories, ammunition, etc.

U.S. Pat. No. 4,084,865 granted to Joyce, which is incorporated by reference as if fully set forth herein, is directed to a utility container comprising a container body, a plurality of drawers, a plurality of drawer guide inserts and a slide cover. The slide cover is substantially biplanar to enclose the front and top of the container body, one edge of the cover being wrapped around the rear panel of the container body and the other edge being wrapped around the bottom of the container body to limit displacement of the cover relative to the container to a lateral sliding displacement. Two or more such containers may be stacked on one another by way of a slot and raised rear wall member. The drawers may be individually removed and temporarily stacked in the top of the container rear wall for improved access to contents.

An accessory box marketed by MTM Molded Products Company of Dayton, Ohio, under the designation CASE-GARD A-760 SHOOTER'S ACCESSORY BOX comprises a box having hingedly attached upper and lower portions. Inserts in the lower portion can be arranged to form individual compartments of various sizes. The upper portion is designed to hold a variety of accessories which are secured by a locking divider. A handle is operably attached to the exterior of the top portion.

Also marketed by MTM Molded Products Company of Dayton, Ohio, under the designation Gunsmith's Maintenance Center is a combination firearm support and accessory tray. The device includes a pair of adjustable, spaced apart forks, configured to support a firearm, extending upwardly from an accessory tray having a plurality of compartments for storing tools and accessories. The forks include molded rubber padding to protect the firearm.

A Portable Rifle Maintenance Center, also marketed by MTM Molded Products Company of Dayton, Ohio, under the designation CASE-GARD RMC- 1 comprises an accessory tray and firearm rest configured to work in tandem with the CASE-GARD A-760 SHOOTER'S ACCESSORY BOX. The maintenance center includes a pair of adjustable, spaced apart upright forks for supporting a firearm. An accessory tray includes a plurality of compartments for storing tools and accessories. Molded dust covers are provided for covering the compartments.

The list that follows is directed to a variety of storage cases for shooting accessories and ammunition found in the related art.

| U.S. Pat. No. | Inventor |
|---|---|
| 1,120,244 | Sachtleben |
| 1,809,696 | Heilweil |
| 2,486,949 | Hutchison |
| 3,039,650 | Hoffmann |
| 3,757,933 | Banta |
| 3,893,725 | Coulter et al. |
| 4,194,657 | Thor |
| 4,566,588 | Kataczynski |
| D196,894 | MacKinnon |
| D216,940 | Stonedahl |
| D237,611 | Minneman |
| D263,987 | Milliman |
| D273,247 | Pigott |
| D278,096 | Walker et al. |
| D284,714 | Thor |
| D312,173 | Smith et al. |

Until now, it is believed that a combination utility storage box, maintenance center and firearm support for use in shooting sports has not been invented.

SUMMARY OF THE INVENTION

The present invention is directed to a utility storage box for firearm accessories and associated tools, which also functions as a maintenance center and firearm support. The preferred embodiment of the storage box of the present invention comprises a top, a base, a front, a back and spaced apart ends defining a substantially hollow container. The container may be constructed of any of a variety of suitable materials, including wood, plastic, metal, which are durable and substantially rigid.

In the preferred embodiment, the interior of the container is accessible by a plurality of drawers, which occupy a portion of the interior of the container, and a hinged door, which opens into another portion of the interior having a plurality of shelves. Any arrangement of drawers and shelves is contemplated to be within the scope of the present invention. For example, one side of the container may have a plurality of drawers and the other side may have shelves which are covered by a hinged door or removable panel. Alternative embodiments may include drawers and shelves on both sides of the container.

The container also includes a handle attached to the top of the container for ease of transport. Alternatively, the container may include hook means, such as D-rings, for attaching a strap for enabling the container to be transported on the shoulder.

The container further includes support arms attached to either end of the container for supporting a firearm.

Accordingly, the arms may be pivoted from a collapsed position, wherein the arms are adjacent the ends of the container, to an upright position, wherein the arms extend vertically upward beyond the top of the container. The arms include notches for receiving a firearm. In the preferred embodiment, the support arms are retained in either the collapsed or the upright position by a locking mechanism. The locking mechanism comprises a pair of oppositely disposed flexible shafts extending from the ends of the container. Each of the shafts terminates in a retaining tab which extends through a bore in the support arm and directly engages the support arm to hold it in the desired position. Each support arm is preferably received within a recessed portion of the end of the container such that the arm is substantially flush with the end of the container.

The container also includes stabilizing means comprising a pair of support legs extendable from a housing in the base. The legs include a handle or handle means for extending and retracting the legs. Feet may be attached to the bottom of the legs and the base. In the preferred embodiment, the stabilizing means further comprises cooperative wedging surfaces positioned within the housing of the base and on the legs so that the wedging surfaces frictionally engage when the legs are extended from the housing.

The stabilizing means may further comprise locking means for locking the legs into any of a plurality of user selected positions. In the preferred embodiment, the locking means further comprises a plurality of teeth positioned within the housing of the base, a flexible tab extending from each of the legs and positioned to cooperatively engage the plurality of teeth. Each of the plurality of teeth includes a locking surface for retaining the tab and preventing the leg from inadvertently retracting into the housing of the base. The locking means may further include means for releasing the tab, such as a depressible button extending through a longitudinal slot in the housing of the base.

The present invention may, therefore, be summarized in a variety of ways, one of which is the following: a utility box for use in shooting sports, comprising a top, a base, a front, a back and spaced apart ends defining a substantially hollow container, the container further including storage means for accommodating a plurality of articles; and means for stabilizing the base of the container. The stabilizing means further comprises a plurality of support legs extendable from a housing in the base. Each of the plurality of legs further comprises handle means for extending and retracting the leg. The box further includes a handle operably attached to the container, and feet attached to the legs and the base for engaging a support surface.

The utility box further includes support means pivotally to the container for supporting a firearm. The support means includes a pair of oppositely disposed support arms having notches along a top surface for receiving a firearm, wherein the support arms are pivotal between a plurality of user selectable positions.

The utility box further includes a locking mechanism for retaining the support arms in any of the user selected positions. The locking mechanism further comprises at least one flexible shaft extending from each end of the container, wherein the at least one shaft terminates in a retaining tab for engaging the support arm when the tab extends through an aperture in the support arm. The at least one flexible shaft further comprises a pair of oppositely disposed flexible shafts extending from each end of the container.

The storage means comprises a plurality of drawers slidably disposed within a portion of the container and a plurality of shelves positioned within a portion of the container and accessible from a door pivotally attached to the container.

The stabilizing means further comprises cooperating wedging surfaces positioned within the housing of the base and at a proximal end of each of the plurality of legs such that the wedging surface at the proximal end of each of the plurality of legs frictionally engages the cooperating wedging surface of the housing when the leg is extended therefrom. The stabilizing means further comprises locking means for locking the plurality of legs in any of a plurality of user selected positions. The locking means further comprises a plurality of teeth positioned within the housing of the base, a flexible tab extending from each of the plurality of legs and positioned to cooperatively engage the teeth when the leg is extended or retracted from the housing, wherein each of the plurality of teeth includes a locking surface to retain the tab and to prevent the leg from retracting into the housing; and means for releasing the tab from the teeth. The means for releasing the tab comprises a button attached to the flexible tab and extending through a longitudinal slot in the housing of the base for releasing the tab.

Yet another way of summarizing the invention is: a utility cabinet for storing shooting accessories, comprising a container having a top, a base, a front, a back and spaced apart ends defining an interior, a plurality of drawers slidably disposed within a portion of the container, a door pivotally attached to the container for accessing the interior of the container, support means pivotally attached to the container for supporting a firearm; and stabilizing means for stabilizing the container. The utility box further includes a handle attached to the top of the container and a plurality of shelves disposed within a portion of the container.

The support means comprises a pair of support arms pivotal between an upright position and a collapsed position, each support arm further including a notch for receiving a firearm; wherein each support arm extends vertically upward beyond the top of the container in the upright position and each support arm is positioned adjacent the container in the collapsed position; and locking means for retaining the support arms in either the upright position or the collapsed position. The locking means comprises a pair of flexible shafts extending from the ends of the container, each shaft terminating in a barb having a retaining surface for engaging the support arm when the barb extends through an aperture in the support arm.

The stabilizing means comprises a pair of legs extendable from the base of the container. A proximal end of each of the plurality of legs widens to form at least one wedging surface for frictionally engaging at least one cooperatively configured wedging surface positioned within the housing of the base when the leg is extended therefrom.

A third way of summarizing the invention is: a shooter's accessory box, comprising a base, a top, a front, a back, and spaced apart ends defining a substantially hollow interior, a plurality of drawers slidably disposed within the interior; a plurality of shelves positioned in the interior; a door for accessing the plurality of shelves; a pair of legs extendable from the base for stabilizing the box; and a pair of oppositely disposed support arms pivotally attached to the box.

It is an object of the present invention to provide a portable utility box useful in the shooting sports comprising a substantially hollow container having a top, a base, a front, a back and spaced apart ends.

It is another object of the present invention to provide a shooter's utility box having a plurality of drawers and shelves for storing tools, accessories and supplies.

It is yet another object of the present invention to provide a utility box having a hinged door for accessing shelves in the interior of the box.

It is another object of the present invention to provide a utility box having support means pivotally attached to the container for supporting a firearm.

It is an object of the present invention to provide a utility box having a pair of support arms pivotal between an upright, extended position and a collapsed position.

It is an object of the present invention or provide a locking mechanism for retaining the support arms in either the upright extended position or the collapsed position.

It is an object of the present invention to provide a utility box having a plurality of extendable legs for stabilizing the box.

It is an object of the present invention to provide locking means comprising a plurality of teeth and a cooperating tab for locking the plurality of legs in any of a plurality of user selected positions.

It is an object of the present invention to provide means for releasing the tab from the teeth to retract the legs.

It is an object of the present invention to provide a housing and a plurality of legs having cooperating wedging surfaces for locking the legs in a user selected position.

These and other objects, features and advantages shall become apparent after consideration of the description and drawings set forth herein. All such objects, features and advantages are contemplated to be within the scope of the present invention even though not specifically set forth herein.

8B is a top view of the tab lock of the support leg of the present invention; and

8C is a top view of the housing of the base of the present invention.

DESCRIPTION OF THE PREFERRED EMBODIMENTS

Figure 1:
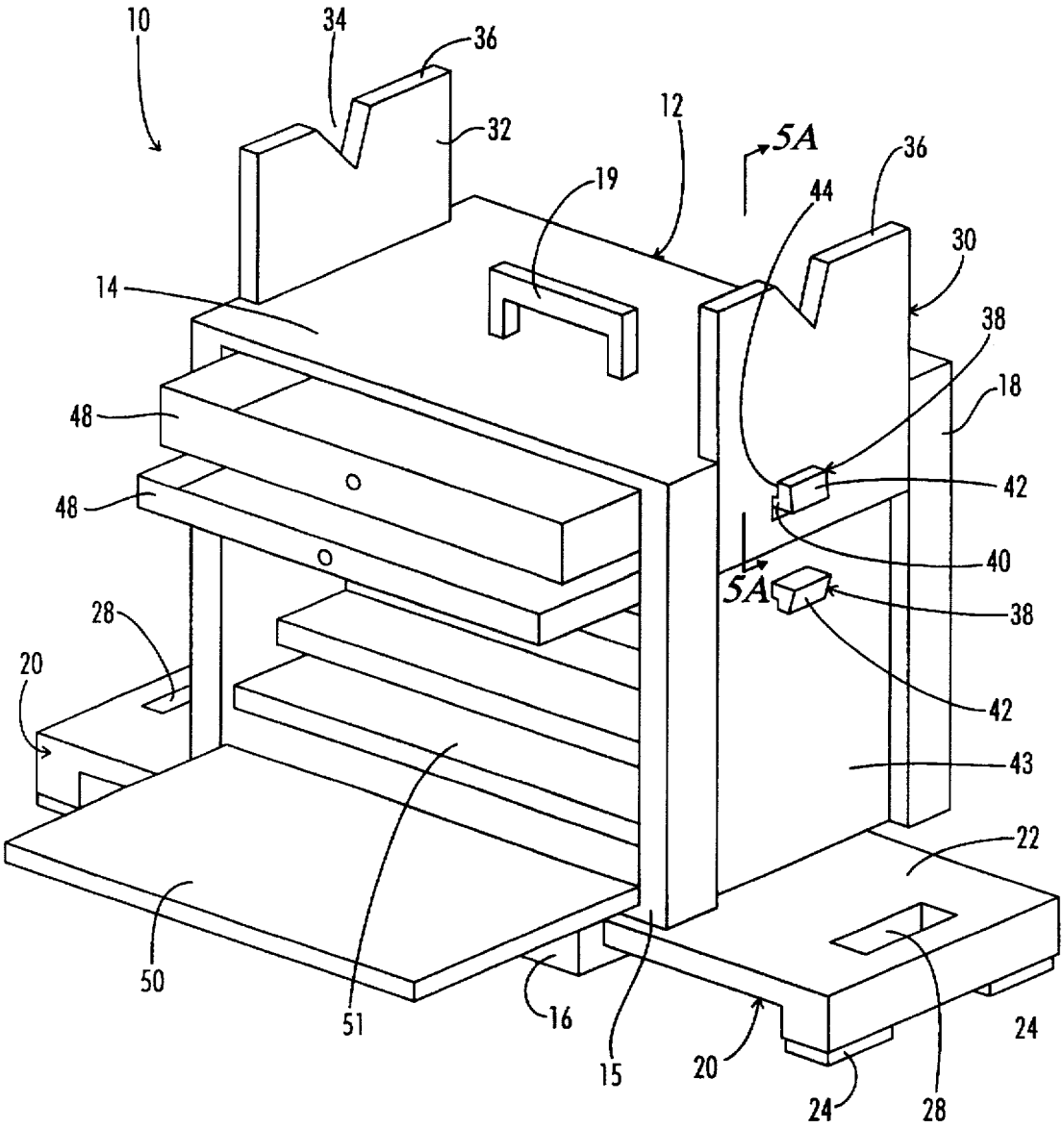
FIG. 1 is an front elevated perspective view of an embodiment of the present invention.
Figure 2:
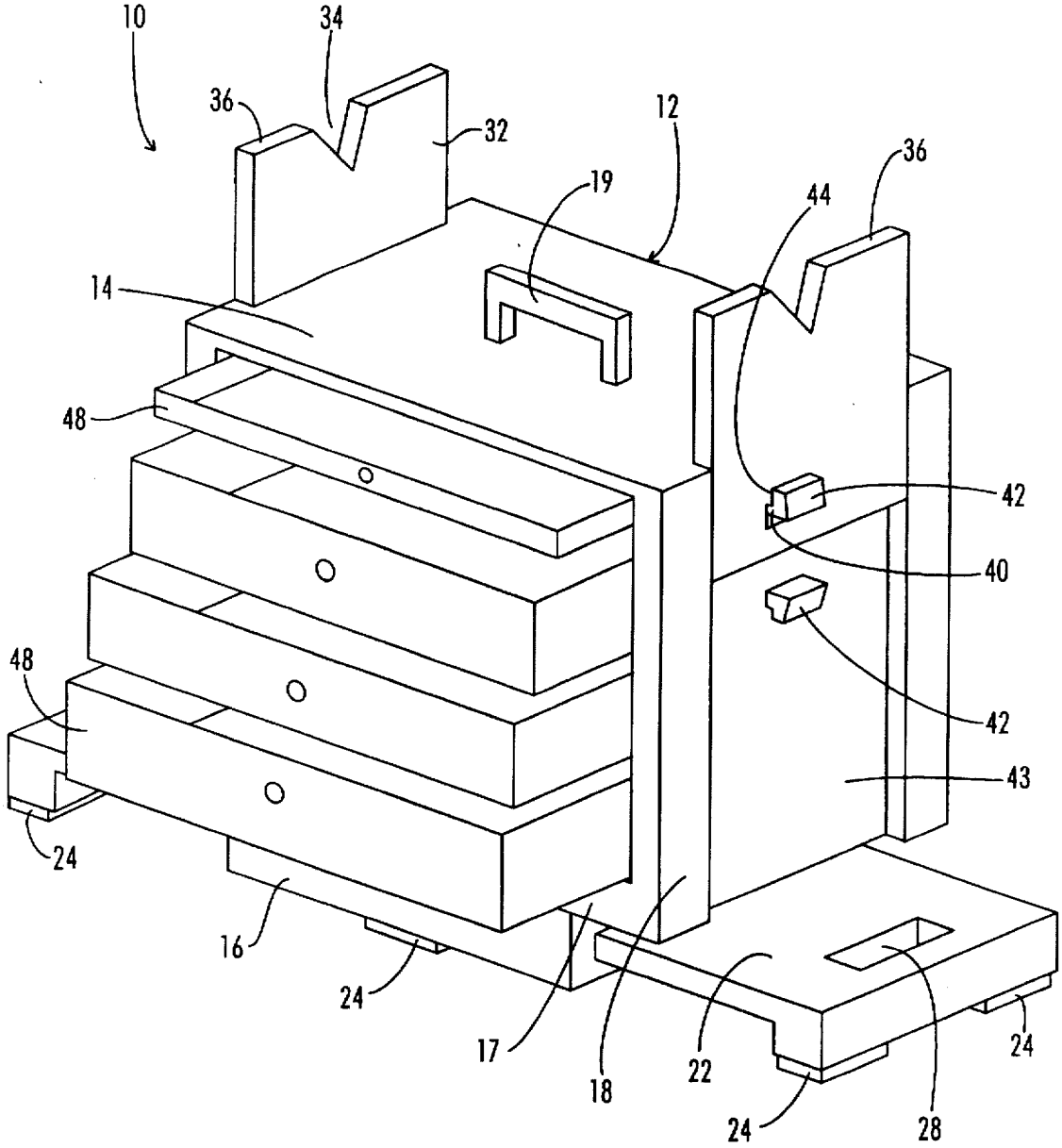
FIG. 2 is a rear elevated perspective view of the embodiment of the invention shown in FIG. 1.

An embodiment of the present invention is designated generally by the reference numeral 10 in FIGS. 1 and 2. Embodiment 10 includes a top 14, a base 16, a front 15, a back 17 and spaced apart ends 18 which define a substantially hollow container or box 12. The box 12 includes storage means for accommodating a plurality of articles, such as ammunition, targets, tools and other accessories. The container 12 includes stabilizing means 20 for stabilizing the box 12 when positioned on a support surface 21. A handle 19 is provided for transporting the container 12.

With reference to FIGS. 1 and 2, the storage means preferably comprises a plurality of drawers 48 slidably disposed within a portion of the interior of the container 12, and a plurality of shelves 51 positioned within a portion of the interior of the container 12 and accessible from a door 50 pivotally attached to the container 12.

Figure 2A:
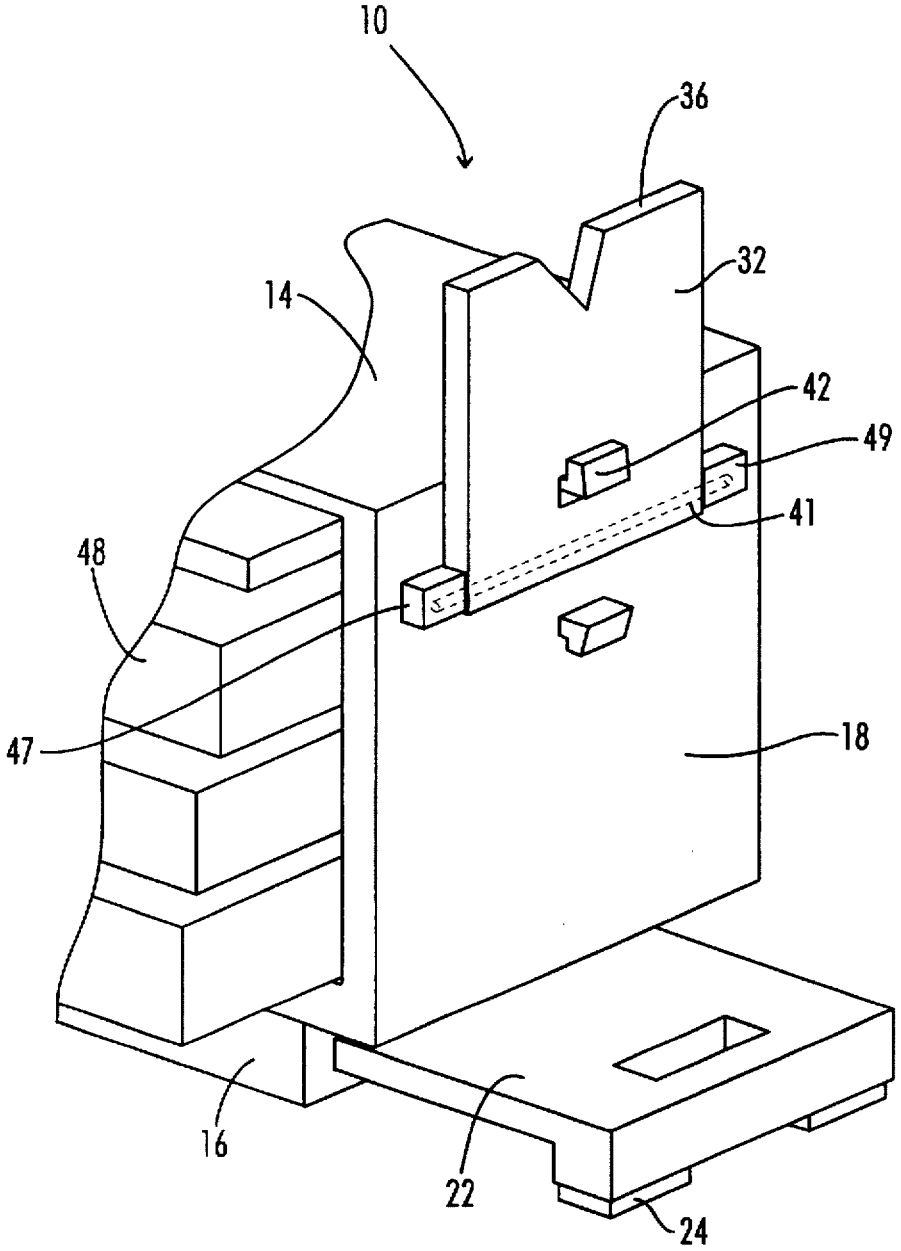
FIG. 2A is a partial elevated perspective view of an alternate embodiment of the invention shown in FIG. 2.
Figure 3A:
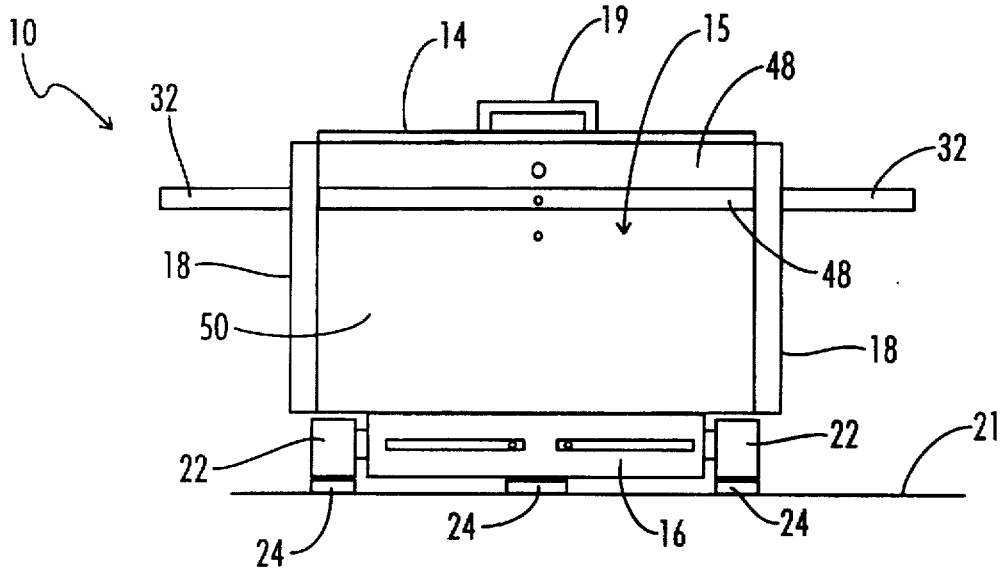
FIG. 3A is a front view of the embodiment of the invention shown in FIG. 1 with the door in a closed position.
Figure 3B:
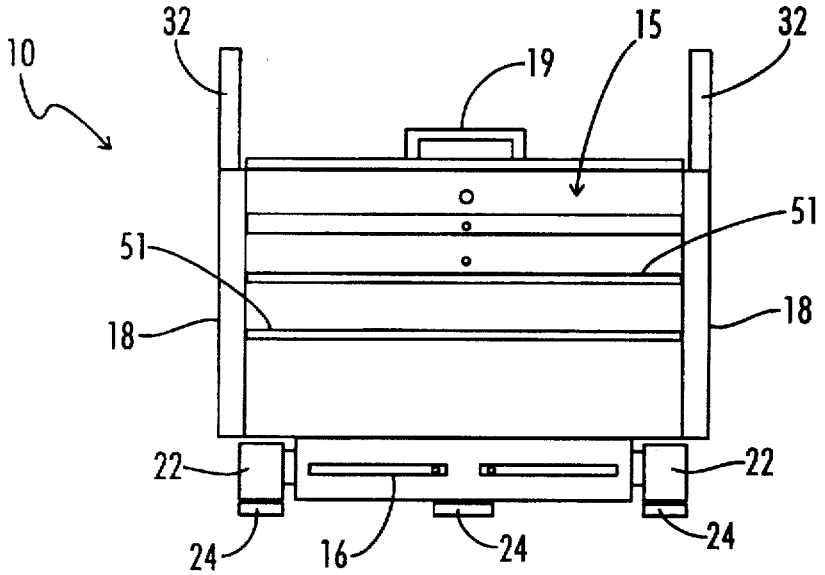
FIG. 3B is a front view of the embodiment of the invention shown in FIG. 1 with the door in an open position to show the interior shelving.
Figure 4A:
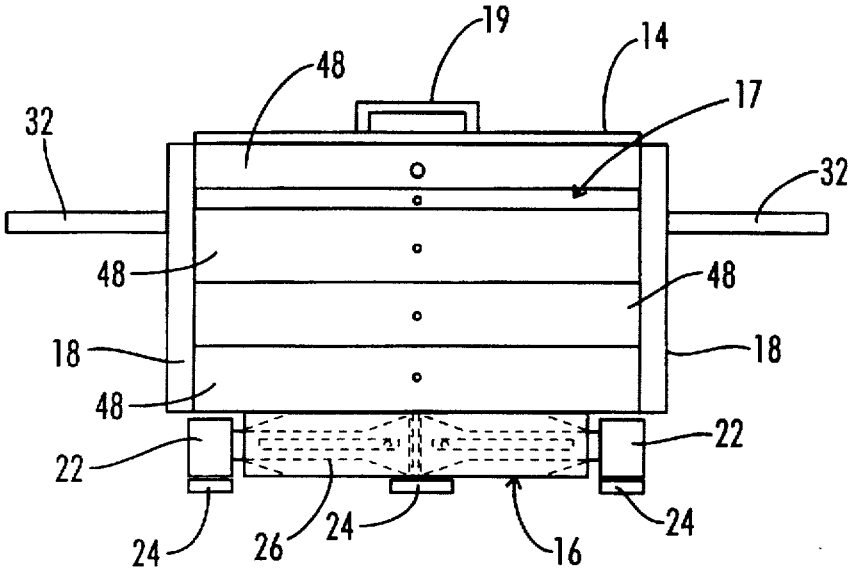
FIG. 4A is a rear view of the embodiment of the invention shown in FIG. 1 with the firearm support arms extended outwardly and the legs retracted into the housing of the base.
Figure 4B:
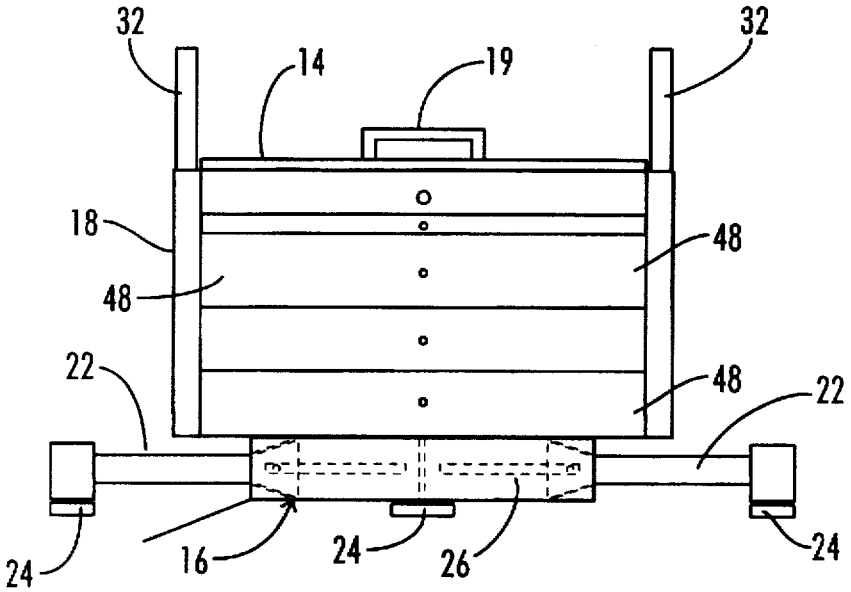
FIG. 4B is a rear view of the embodiment of the invention shown in FIG. 1 with the firearm support extended upwardly and the legs extended from the housing of the base.
Figure 5A:
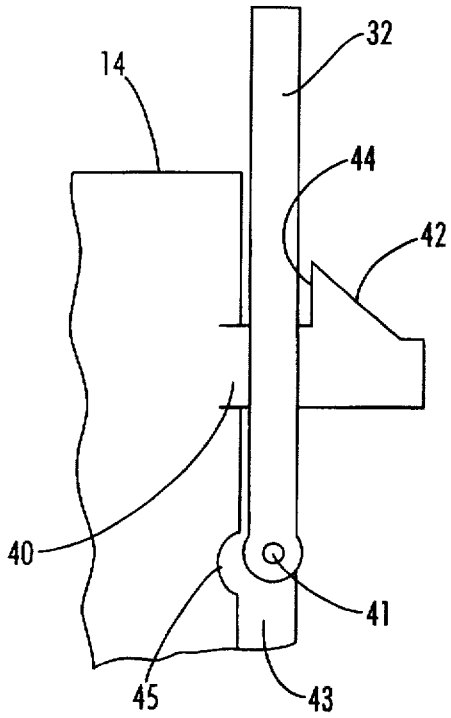
FIG. 5A is a partial sectional view of the support arm locking mechanism taken along lines 2—2 of FIG. 1.
Figure 5B:
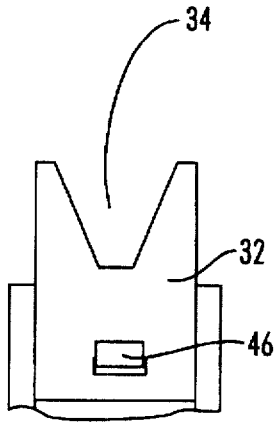
FIG. 5B is a partial front view of the support arm and locking mechanism shown in FIG. 5A.

With reference to FIGS. 1, 5A and 5B, the container 12 further includes support means 30 pivotally attached to the container for supporting a firearm. In the preferred embodiment, the support means 30 comprises a pair of oppositely disposed support arms 32 pivotally attached at the ends 18 of the container 12 and operable between an upright position and a collapsed position. In the upright position, the support arms 32 extend substantially vertically upward beyond the top of the container 12. In the collapsed position, the support arms 32 are pivoted downward to a position adjacent the ends 18 of the container 12. A top surface 36 of each support arm 32 includes a notch 34 for receiving a portion of a firearm. Accordingly, a firearm may be positioned in the notches 34 when the support arms 32 are pivoted to the upright position. A shaft 41 having spaced apart ends extends through a bore in each support arm 32 to pivotally attach the arm 32 to the box 12. The ends of the shaft 41 are received within aligned bores in a pair of anchors 47 and 49 projecting from the end 18 of the box 12 adjacent the support arm 32 (see FIG. 2A).

In an alternate embodiment, each arm 32 is received within a recess 43 formed in the end 18 of the box 12 (FIGS. 1 and 2). Accordingly, the arms 32 are substantially flush with the ends 18 of the box 12 when the arms 32 are in either the upright position or the collapsed position. The ends of the shaft 41 are received within aligned bores positioned within the recessed portion 43 of the end 18 of the box 12. The pivotally attached end of the support arm 32 may be convex or rounded to facilitate pivotal movement of the arm 32. Moreover, a concave notch 45 configured to receive the convex end of the support arm 32 may be formed within the recess 43 to further facilitate the pivotal movement of the support arm 32.

In the preferred embodiment, the support means 30 further comprises a locking mechanism 38 for retaining the support arms 32 in either of the user selected positions. The locking mechanism 38 preferably comprises a pair of oppositely disposed flexible shafts 40 extending from each end 18 of the container 12, each shaft 40 terminating in a retaining tab or barb 42 having a locking surface 44 for holding the support arm 32 in position. The locking surface 44 engages the support arm 32 when the retaining tab 42 extends through an aligned bore 46 in the support arm 32.

Figure 6A:
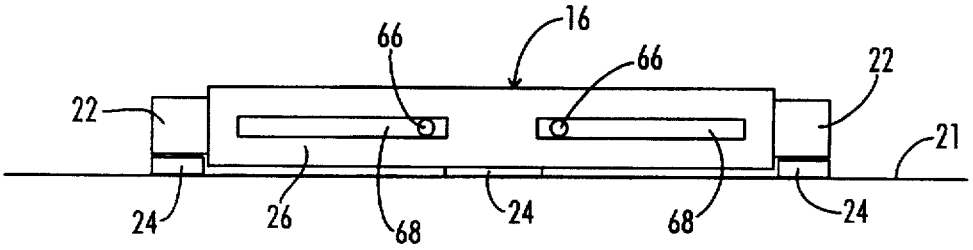
FIG. 6A is a front view of the base of the present invention with the legs shown in a retracted position.
Figure 6B:
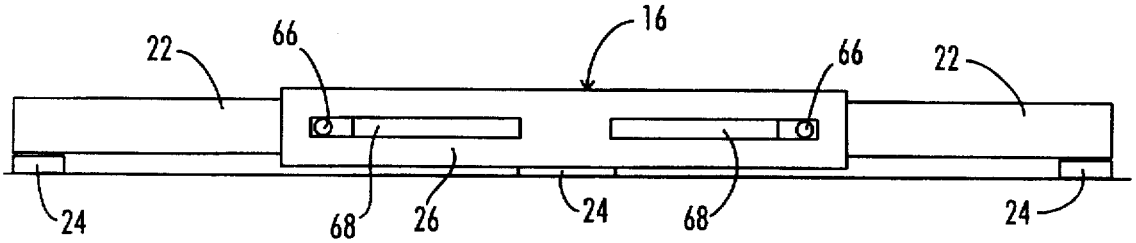
FIG. 6B is a front view of the base of the present invention with the legs shown in an extended position.
Figure 7A:
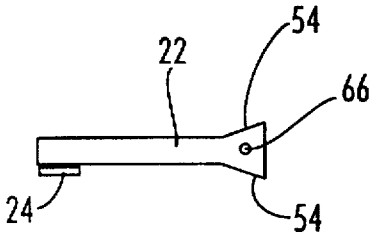
FIG. 7A is a side view of the housing of the base of the present invention.
Figure 7B:
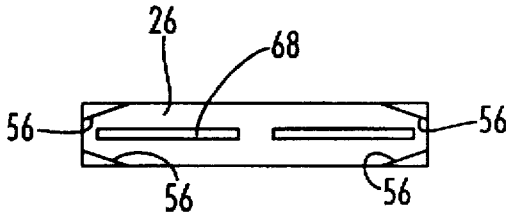
FIG. 7B is a side view of the housing of the base of the present invention.

With reference to FIGS. 6A and 6B, the stabilizing means 20 comprises a pair of support legs 22 extendable from a housing 26 in the base 16. In the preferred embodiment, each of the legs 22 includes handle means 28 for extending and retracting the leg 22. The stabilizing means 20 further comprises cooperating wedging surfaces 54 positioned within the housing 26 of the base 16 and at a proximal end of each of the plurality of legs 22 (see FIGS. 7A and 7B). Accordingly, the wedging surface 54 at the proximal end of each of the legs 22 frictionally engages the cooperating wedging surface 56 positioned within the housing 26 of the base 16 when the leg 22 is extended therefrom. In the preferred embodiment, the proximal end of each of the plurality of legs 22 widens to form oppositely disposed wedging surfaces 54 for engaging the cooperatively configured wedging surfaces 56 in the housing 26 of the base 16.

Figure 8A:
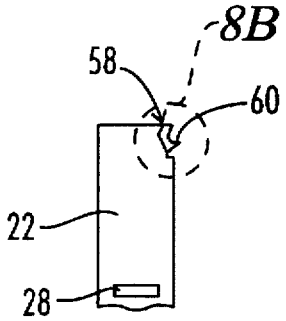
FIG. 8A is a top view of one of the support legs of the present invention.
Figure 8B:
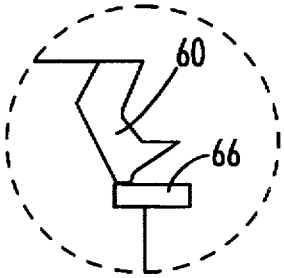
Figure 8C:
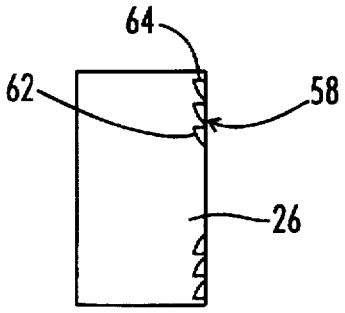

With reference to FIGS. 8A, 8B and 8C, the stabilizing means 20 may further comprise a locking mechanism 58 for locking each of the plurality of legs 22 in any of a plurality of user selected positions. In the preferred embodiment, the locking mechanism 58 further comprises a plurality of spaced apart teeth 62 positioned within the housing 26 of the base 16. A flexible tab 60 extends from each of the plurality of legs 22 and is positioned to cooperatively engage the plurality of teeth 62 when the leg is extended from or retracted into the housing 26. Each of the plurality of teeth 62 includes a locking surface 64 for retaining the flexible tab 60 and, thus, preventing the leg 22 from retracting into the housing 26.

The locking mechanism 58 further comprises means for releasing the tab 60 such that the leg 22 may be slidably retracted into the housing 26. The means for releasing the tab 60 preferably comprises a button 66 attached to the tab 60 and extending outwardly through a longitudinal slot 68 in the housing 26 of the base 16. Accordingly, the button 66 may be depressed to disengage the tab 60 from the teeth 62 such that the leg 22 may be retracted.

The base 16 and the plurality of legs 22 may further include feet 24 for engaging a support surface 21.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected by the appended claims.

What is claimed is:

1. A utility box for use in shooting sports, comprising:

a top, a base, a front, a back and spaced apart ends defining a substantially hollow container;

the container further including storage means within the container for accommodating a plurality of articles;

means for stabilizing the base of the container, wherein the stabilizing means comprises a plurality of support legs extendable from a housing in the base; and wherein each leg of the plurality of legs further comprises handle means for extending and retracting the leg, the handle means including a recess formed in a top surface of each leg.

2. The utility box of claim 1, further comprising:

support means pivotally attached at the spaced apart ends of the container for supporting a firearm.

3. The utility box of claim 2 wherein the support means comprises:

a pair of oppositely disposed support arms each having a notch along a top surface for receiving a firearm, wherein the support arms are pivotal between a plurality of user selectable positions.

4. The utility box of claim 3, further including:

a locking mechanism for retaining the support arms in any of the user selected positions.

5. The utility box of claim 4 wherein the locking mechanism further comprises:

at least one flexible shaft extending from each end of the container, wherein the at least one shaft terminates in a retaining tab for engaging the support arm when the tab extends through an aperture in the support arm.

6. The utility box of claim 1, further comprising:

a handle operably attached to the container.

7. The utility box of claim 1 wherein the storage means comprises:

a plurality of drawers and a plurality of shelves disposed within the container; and a door pivotally attached to the container for accessing the plurality of shelves.

8. The utility box of claim 1, wherein the stabilizing means furthers comprises:

cooperating wedging surfaces positioned within the housing of the base and at a proximal end of each of the plurality of legs such that the wedging surface at the proximal end of each of the plurality of legs frictionally engages the cooperating wedging surface of the housing when the leg is extended therefrom.

9. The utility box of claim 1 wherein the stabilizing means further comprises:

locking means for locking the plurality of legs in any of a plurality of user selected positions.

10. The utility box of claim 9 wherein the locking means further comprises:

a plurality of teeth positioned within the housing of the base, a flexible tab extending from each of the plurality of legs and positioned to cooperatively engage the teeth when the leg is extended or retracted from the housing;

wherein each of the plurality of teeth includes a locking surface to retain the tab and to prevent the leg from retracting into the housing, and means for releasing the tab from the teeth.

11. The utility box of claim 10 wherein the means for releasing the tab comprises:

a button attached to the flexible tab and extending through a longitudinal slot in the housing of the base.

12. A utility cabinet for storing shooting accessories, comprising:

a container having a top, a base, a front, a back and spaced apart ends defining an interior, storage means disposed within the container, wherein the storage means comprises a plurality of drawers slidably disposed within the container;

support means pivotally attached to the container for supporting a firearm, wherein the support means comprises a pair of support arms pivotal between an upright position and a collapsed position, each support arm further including a notch for receiving a firearm, locking means for retaining the support arms in either the upright position or the collapsed position wherein the locking means comprises a pair of flexible shafts extending from the ends of the container, each shaft terminating in a barb configured to engage the support arm when the barb extends through an aperture in the support arm to hold the support arm in either the upright position or the collapsed position, and stabilizing means for stabilizing the container.

13. The utility box of claim 12, wherein the storage means further comprises:

a plurality of shelves disposed within the container; and a door hingedly attached to the container for accessing the shelves.

14. The utility box of claim 12 wherein the support means comprises:

a pair of support arms pivotal between an upright position and a collapsed position, each support arm further including a notch for receiving a firearm;

wherein each support arm extends vertically upward beyond the top of the container in the upright position and each support arm is positioned adjacent the container in the collapsed position; and locking means for retaining the support arms in either the upright position or the collapsed position.

15. The utility box of claim 12 wherein the stabilizing means comprises:

a pair of legs extendable from the base of the container.

16. The utility box of claim 15, wherein:

a proximal end of each of the plurality of legs widens to form at least one wedging surface for frictionally engaging at least one cooperatively configured wedging surface positioned within the housing of the base when the leg is extended therefrom.

17. A shooter's accessory box, comprising:

a base, a top, a front, a back, and spaced apart ends defining a substantially hollow interior;

storage means disposed within the interior, wherein the storage means comprises at least one drawer slidably disposed within the interior;

a pair of legs extendable from the base for stabilizing the box, each of the legs having handle means for extending and retracting the leg;

a pair of oppositely disposed firearm support arms pivotally attached to the box configured to support a firearm;

wherein each of the support arms includes a notch along a top surface configured to receive a firearm;

a locking mechanism for retaining the support arms in any of a plurality of user selectable position, wherein the locking mechanism further comprises at least one shaft extending from each end of the container, the at least one shaft terminating in a retaining tab configured to engage the support arm when the tab extends through an aperture in the support arm.

18. The shooter's accessory box of claim 17, wherein the storage means further comprises:

a plurality of shelves disposed within the container; and a door pivotally attached to the box for accessing the plurality of shelves.

* * * * *